US006859637B2

(12) United States Patent
Kawai

(10) Patent No.: US 6,859,637 B2
(45) Date of Patent: Feb. 22, 2005

(54) IMAGE READING APPARATUS, IMAGE READING METHOD AND DOCUMENT FEEDER APPARATUS

(75) Inventor: Masaaki Kawai, Minami-alps (JP)

(73) Assignee: Nisca Corporation, Yamanashi-ken (JP)

( * ) Notice: Subject to any disclaimer, the term of this patent is extended or adjusted under 35 U.S.C. 154(b) by 28 days.

(21) Appl. No.: 10/635,476

(22) Filed: Aug. 7, 2003

(65) Prior Publication Data

US 2004/0062580 A1 Apr. 1, 2004

(30) Foreign Application Priority Data

Aug. 7, 2002 (JP) ..... 2002-230578

(51) Int. Cl.[7] ..... G03G 15/00

(52) U.S. Cl. ..... 399/367; 399/370; 399/371; 399/376

(58) Field of Search ..... 399/361, 365, 399/367, 368, 370, 371, 373, 376; 271/3.01, 3.13, 265.02

(56) References Cited

U.S. PATENT DOCUMENTS 6,321,064 B1 * 11/2001 Mizubata et al. ..... 399/370
6,393,251 B2 * 5/2002 Kono ..... 399/370

* cited by examiner

*Primary Examiner*—Hoan Tran
(74) *Attorney, Agent, or Firm*—Manabu Kanesaka

(57) ABSTRACT

An image reading apparatus includes a transport path for guiding an original from an original tray to a reading position; a transport device for transporting the original toward a downstream side in a forward direction or toward an upstream side in a reverse direction; a reading device for reading the original at the reading position; a determining device for determining whether the original has a black and white image or color image; and a retreat path disposed at an upstream side of the reading position for retreating at least a part of the original from the transport path. After the determining device determines the original, the original is transported in the reverse direction to retreat it to the retreat path. Then, the original is transported to the reading position, so that the reading device reads the original in a reading mode according to a result of the determination.

16 Claims, 17 Drawing Sheets

Spectral Responsivity Characteristics

Black/White Original Spectral Reflectance Data

IMAGE READING APPARATUS, IMAGE READING METHOD AND DOCUMENT FEEDER APPARATUS

BACKGROUND OF THE INVENTION AND RELATED ART STATEMENT

The present invention relates to an image reading apparatus with an automatic document feeder apparatus (ADF) and an image reading method for reading an original transported to a platen. More particularly, the present invention relates to an image reading apparatus and an image reading method that determine whether an original to be read includes black and white images or color images, and read the images on the original according to a result of the determination.

In recent years, a computer, the Internet and electronic photos are widely used to handle color images. Accordingly, there has been an increasing demand for copying, printing, and transmitting the color images because of the superior quality as opposed to black and white images. For that reason, an image reading apparatus has been required to quickly read a color original with high quality.

However, when an image reading apparatus reads a color original, it is normally necessary to read image data for each of the three primary colors, namely red (R), green (G) and blue (B). Thus, when reading a color original with the same resolution as that of a black and white original, the image reading apparatus has to read at a speed than slower for reading a black and white original.

An image reading apparatus may read a set of originals including both color originals and black and white originals. When the apparatus reads such a set of originals in a color reading mode, a speed of reading the black and white originals will be dramatically slowed.

To solve this problem, a conventional apparatus pre-scans an original to determine whether the original has a black and white image or color image. Then, when the original has only a black and white image, the image reading apparatus reads at a comparatively high speed in a black and white mode. Conversely, when he original has a color image, the image reading apparatus uses the color reading mode with a slower speed. This system is known as the 'pre-scan/actual scan method'.

In Japanese Patent Publication (Kokai) No. 09-261417, an image processing apparatus has been disclosed as a modified version of the 'pre-scan/actual scan method'. The reading apparatus is provided with a re-circulating document feeder. It is determined if the original has a black and white image or color image for all documents on the document tray through a process of transporting the originals through a reading position inside the apparatus. Then, the apparatus stores a result for each page of the originals stacked on the original tray. Next, for the actual reading, the originals are returned to the original tray and sequentially fed in the same order. Then, the determination result is retrieved for each original, and the originals are read according to the results based on whether the original has a black and white image or color image.

An image reading apparatus disclosed in U.S. Pat. No. 5,946,527 also employs the pre-scan/actual scan method to determine whether a original is in black and white or in color by reading the original in the process to pass the original on an original tray through a reading position. Then, the original is read again according to a result of the determination.

In the image reading apparatus, it is determined whether the original fed from the original tray includes a black and white image or color image when the original passes through the reading position on the platen. In the image reading apparatus, it is possible to rotate discharge rollers in both directions for discharging the original to the discharge tray. Thus, it is possible to reverse and transport the original to the reading position again, so that both sides of the original can be placed on the reading position.

Therefore, when the original passes through the reading position for the first time, the apparatus determines whether the original has a black and white image or color image. After a leading edge of the original is discharged to the discharge tray, the discharge rollers are rotated in reverse to switchback the original. The original is turned over front to back, so when passing through the reading position for the second time, the apparatus does not read the original. After the original is switched back again on the discharge tray, when the original passes through the reading position for the third time, the image thereupon is read according to the result obtained when the original passes through the reading position for the first time. While the apparatus stores the image data, the original is discharged to the discharge tray.

Also, Japanese Patent Publication (Kokai) No. 11-2931 has disclosed an apparatus in which a set of originals having differing sizes is placed on the original tray. The original passes through a reading position to determine a size of the original, and is subsequently sent to the discharge tray. The original is transported to the reading position again for reading. This apparatus employs a transport mechanism for determining the size of the original. It may be possible to determine whether an original has a black and white image or color image if a reading device such as a CCD is installed at a position where the original size detection sensors are arranged in the transport mechanism.

In the image reading apparatus with the pre-scan/actual scan method described above, the original is transported through the same path when the original is read with only the actual scan and the original is read with both the pre-scan and the actual scan. Therefore, it is difficult to reduce a processing time when the image reading apparatus with the pre-scan/actual scan method reads a set of originals including both black and white originals and color originals.

In addition to the problems described above, the apparatus disclosed in Japanese Patent Publication (Kokai) No. 09-261417 has a large size because the original is discharged to the original tray to re-circulate through the tray. Also, it is necessary to provide a memory with a large capacity for storing the results for all the originals in one circulating operation. Furthermore, when the original is jammed during the actual scan, or some of the originals are mistakenly removed from the original tray after completing the first determination scan (pre-scan), an order of the originals is changed and the apparatus uses incorrect results for the actual scan.

The apparatus disclosed in U.S. Pat. No. 5,946,527 employs the pre-scan/actual scan method, and uses the transport path for reading both sides of the original as described above. The apparatus determines a type of original when the original passes through the reading position for the first time (pre-scan) When the original is turned over front to back and passes through the reading position for the second time, the original is not read. When the original is switched back and passes through the reading position for the third time, the apparatus reads the original (actual scan) according to the determination result in the first reading. Therefore, it is necessary to turn over the original without reading it when the original passes through the reading position. Thus, it is difficult to read the color original at a high speed, thereby taking longer to read the original.

In view of the problems described above, the first object of the present invention is to provide an image reading apparatus and image reading method having a function for determining whether an original includes a black and white image and color image with one reading means without returning the original to a discharge tray, when reading a stack of originals containing both black and white originals and color image originals.

The second object of the present invention is to provide an image reading apparatus and image reading method with an improved overall reading speed for reading an original quickly according to a result of determination after determining whether the original is in black and white or contains color images without the original passing through the reading position and turning over.

The third object of the present invention is to provide an image reading apparatus and image reading method with an improved processing speed while preventing damage on an original. When an original is read up to a trailing edge thereof for determining whether the original is in black and white or contains color images, the original may be easy to bend or fold. In that case, when the original is determined to have a color image, the original is returned to a reading position, or the original is transported to a circulating path for turning over and is returned to the reading position according to a position the original.

Further objects and advantages of the invention will be apparent from the following description of the invention.

SUMMARY OF THE INVENTION

In order to attain the aforementioned objects, according to the present invention, an image reading apparatus comprises a transport path for guiding an original fed from an original tray to a reading position; transport means for transporting the original toward a downstream side in a forward direction or toward an upstream side in a reverse direction; reading means for reading the original at the reading position; determining means for determining whether the original read by the reading means has a black and white image or color image; and a retreat path disposed at an upstream side of the reading position for retreating at least a part of the original from the transport path. After the determining means determines the original, the original is transported in the reverse direction to retreat it the retreat path. Then, the original is transported to the reading position, so that the reading means reads the original in a reading mode according to a result of the determination.

In the invention, after being determined, the original is transported in the reverse direction to retreat in the retreat path without returning to the original tray. Then, the original is transported to the reading position, so that the reading means reads the original in a reading mode according to a result of the determination.

In the invention, the original is transported at a first transport speed when the determining means determines the original. The original is transported in the reverse direction to the reading position at a second transport speed. The original is transported and read at a third transport speed. The first, second and third transport speed are set separately. It is preferred to set so that the second transport speed is higher than the first transport speed, and the first transport speed is higher the third transport speed. With this configuration, the original is read at a speed corresponding to a reading mode, thereby improving the reading speed.

In the invention, in order to further improve the reading speed, when the determining means determines the original to contain a color image, the reading means stops reading the original, and the transport means transports the original in the upstream direction. The image reading apparatus comprises detection means for detecting whether the original has a length long enough for retreating to the retreat path. When the determining means determines that the original contains a color image, the transport means switches the forward direction at a timing controlled according to a position of a trailing edge of the original.

According to the invention, an image reading method comprises the steps of feeding an original on an original tray and transporting the original to a reading position; reading the original at the reading position; determining whether the original has a black and white image or color image; transporting a leading edge of the original toward an upstream side of the reading position in a reverse direction; transporting the original transported in the reverse direction to the reading position again; and reading the original again using a reading mode according to a result of the determination. Before the step of transporting the original in the reverse direction there is a step of checking whether the trailing edge of the original is situated at a position where the original can be transported in the reverse direction.

According to the invention, an image reading apparatus comprises a transport path disposed between an original tray and a reading position; transport means for transporting an original toward a downstream side in a forward direction or toward an upstream side in the reverse direction; reading means for reading the original at the reading position; determining means for determining whether the original read by the reading means has a black and white image or color image; detection means for detecting whether a trailing edge of the original passes through the reading position; and switching means for switching the transport means from the forward direction to the reverse direction for returning the original to the original tray, and switching the transport means again to the forward direction when the trailing edge of the original passes the reading position. The reading means reads the original in a reading mode according to a result of the determining means.

In the invention, it is possible to eliminate transporting the original twice and reduce a transport time from a pre-scan to an actual scan and an overall reading time. Also, the image reading apparatus comprises a retreat path branching from the transport path for retreating the original transported in the reverse direction. The original is transported in the reverse direction until the leading edge thereof passes through the reading position.

According to the invention, an image reading method comprising the steps of transporting an original on an original tray to a reading position; reading an image on the original passing through the reading position; determining whether the original has a black and white image or color image; transporting the original toward the original tray after a trailing edge of the original passes the reading position; transporting the original toward a downstream side after the leading edge of the original passes the reading position so that the leading edge of the original passes the reading position again; and reading the original in a reading mode according to a result of the determination when the original passes through the reading position again.

According to the invention, an image reading apparatus comprises a transport path disposed between an original tray and a reading position, transport means for transporting the original toward a downstream side in a forward direction or toward an upstream side in a reverse direction; reading means for reading the original at the reading position; determining means for determining whether the original read by the reading means has a black and white image or color image; a circulating path disposed at a downstream side of the reading position for returning the original to the reading position; detection means for detecting a trailing edge of the original; judging means for determining whether the original is transported to the reading position by transporting the original in the forward direction after the transport means transports the original in the reverse direction, or by guiding the original through the circulating path after the original passes through the reading position according to a position of a trailing edge of the original when the determining means determines that the original has a color image. The reading means reads the original passing through the reading position for the second time in a reading mode according to a result of the determining means.

In the invention, the circulating path is configured of a switchback path for turning over the original from front to back to switch the leading edge and trailing edge of the original. The original transported via the circulating path is read at the reading position after circulating twice through the circulating path. At least a part of the original transported by the transport means in the reverse direction is retreated into the retreat path branching from the transport path.

According to the invention, an image reading method comprises the steps of transporting an original on an original tray to a reading position; reading an original passing through the reading position; determining whether the original has a black and white or color image; detecting a position of a trailing edge of the original; judging whether the original is transported to the reading position by transporting the original in the forward direction after the transport means transports the original in the reverse direction, or by guiding the original through the circulating path after the original passes through the reading position according to a position of a trailing edge of the original when the original is determined to have a color image; transporting the original to the reading position again according to the judgment; and reading the original in a reading mode according to a result of the determination.

In the invention, it is possible to select between switching back the original and returning the original in the reverse direction according to the position of the original when the original is determined to have a black and white image or color image. Therefore, in a case that It is not necessary to switch back the original, it is possible to read the original without the switchback, thereby improving transport efficiency for reading the original. Furthermore, when the original is thin, and easy to bend upon switching the transport direction, it is possible to handle such an original with the switchback turn over, thereby eliminating damage on the original.

DETAILED DESCRIPTION OF PREFERRED EMBODIMENTS

Figure 1:
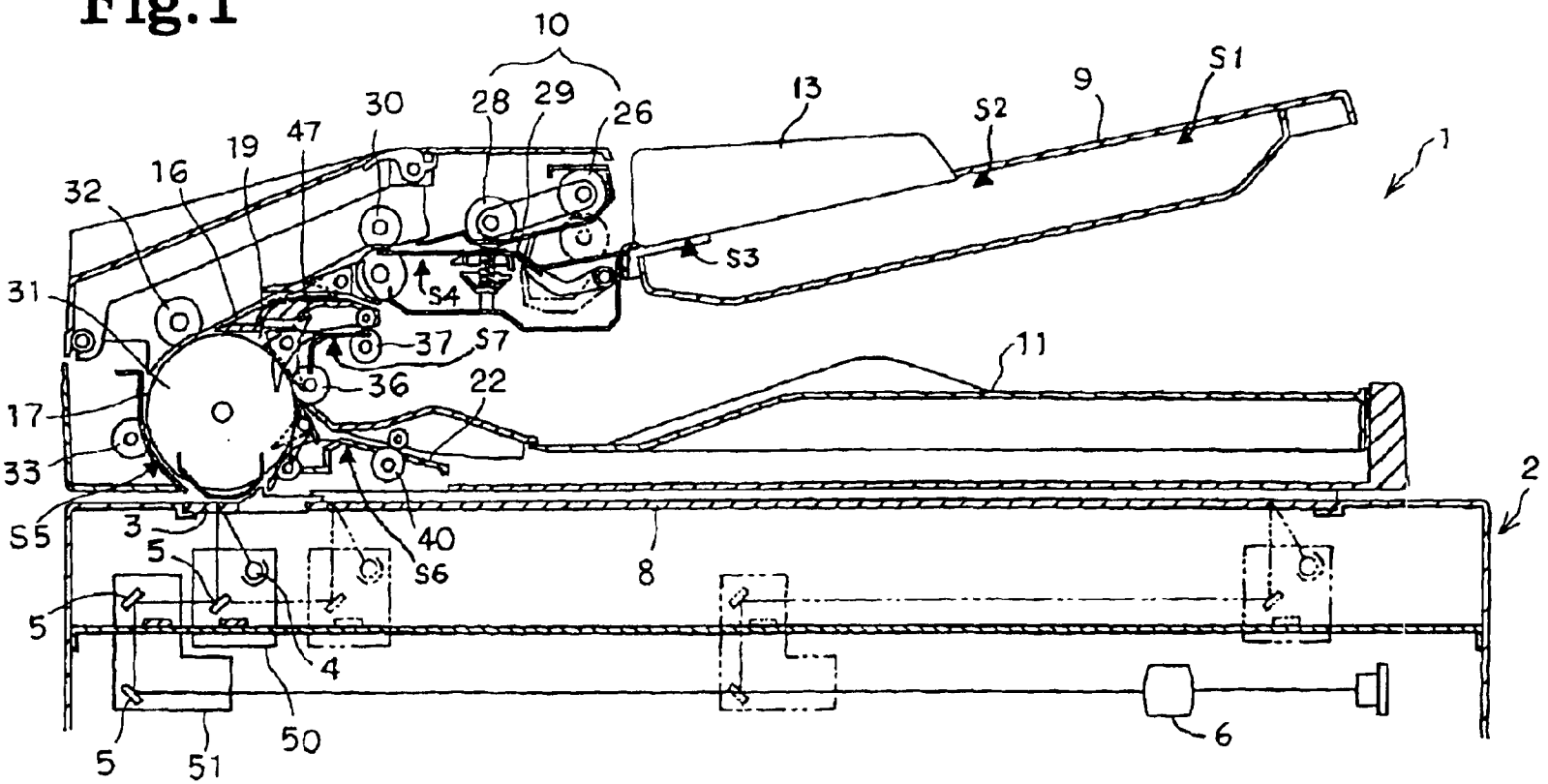
FIG. 1 is a view showing an image reading apparatus according to the present invention.
Figure 2:
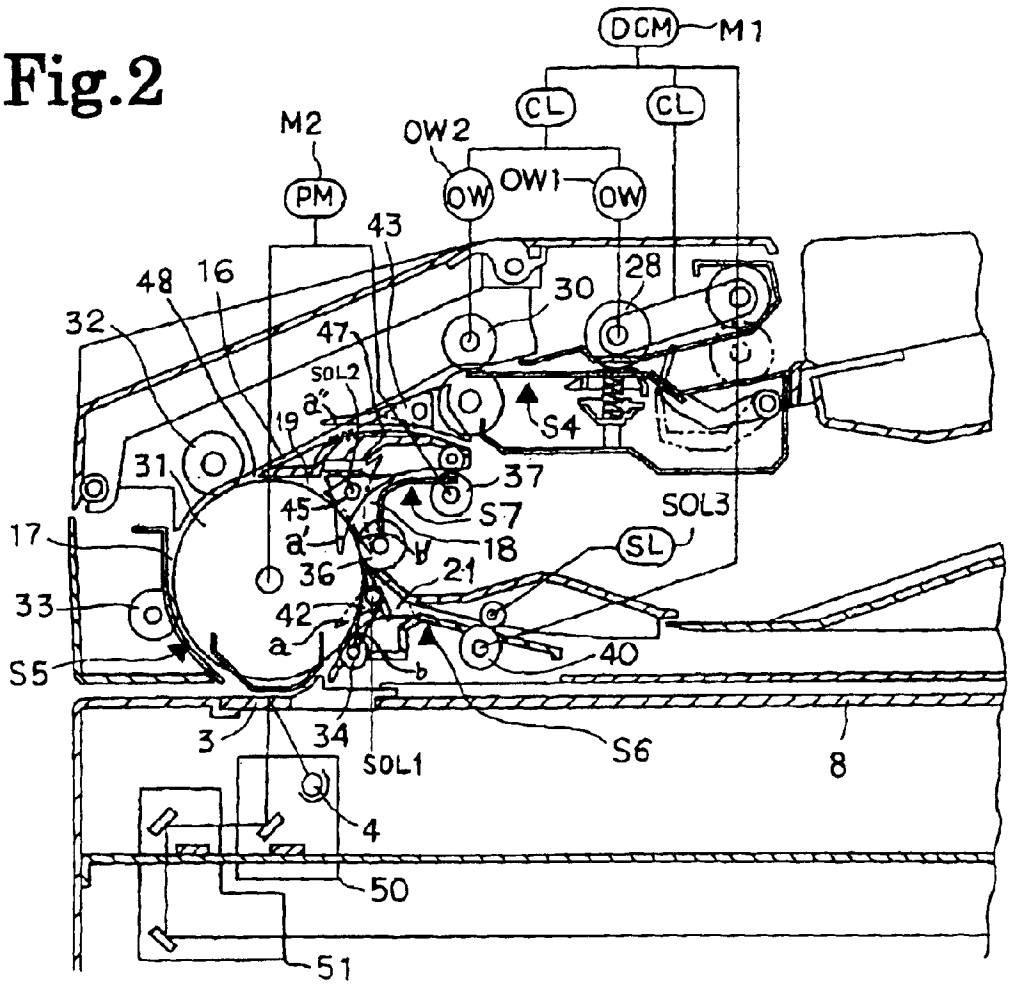
FIG. 2 is a view showing an original transport mechanism of an ADF shown in FIG. 1.

Hereunder, preferred embodiments of the invention will be described in detail with reference to the accompanying drawings. FIG. 1 is a sectional view of an automatic document feeder (hereinafter referred to as ADF) and a reading device of an image reading apparatus according to the first embodiment of the present invention. As shown in FIG. 1, the image reading apparatus is provided with the ADF 1 and the reading device 2. FIG. 2 shows an original transport mechanism of the ADF. The ADF 1 is mounted on the reading device 2 to transport an original to a top surface of the first platen 3 on the reading device 2.

The reading device 2 irradiates a transported original with light from a light source 4 such as a lamp through the first platen 3. The light reflected by the mirrors 5 forms an image on the condenser lens 6 to read the image on the original using the image sensor, i.e. reading means such as a charged couple device (CCD). Specifically, the first platen 3 is the reading position (reading unit) on the reading device 2. Also, the reading device 2 is provided with a second platen 8 with a surface area large enough to cover the entire surface of an original. The reading device 2 can read a thick original such as a book by opening the ADF 1 and placing the thick original on the second platen 8. The first carriage 50 and the second carriage 51 composed of the light source 4 and the collecting mirror 5 move in the sub-scanning direction to read the image on the thick original, via the second platen 8.

The ADF 1 is equipped with the original tray 9 for stacking a plurality of originals; supply means 10 for supplying an original stacked on the original tray 9 one at a time to a reading position; and a discharge tray 11 for storing an original discharged from the reading position.

Also, the ADF 1 comprises the sheet supply path 16 for supplying an original stacked on the original tray to a reading position on the first platen 3 one at a time; the transport path 17 connected to the sheet supply path 16 for guiding the original along the top of the first platen 3; the discharge path 18 extending from the transport path 17 and connected to the discharge tray 11; the first circulating path 19 for guiding the original from the discharge path 18 to the reading position again; the second circulating path 20 joined to the connecting potion of the sheet supply path 16 and the transport path 17 for returning the original from the discharge outlet on the discharge tray 11 to the reading position; an intermediate path 21 branching from the discharge path 18 for guiding the original from the transport path 17; and the switchback path 22 for switching back the original transported from the intermediate path 21.

In a duplex reading mode, the switchback rollers 40 nip the trailing edge of the original to read the images on both sides of the original. Then, the rollers rotate in reverse to switch back a travel direction of the original from front to back. The rollers are controlled to transport the original to the reading position on the first platen 3 via either the first circulating path 19 or the second circulating path 20.

According to the invention, the original transport means has a function for re-transporting the original to a predetermined reading position. That is, after the original is transported in the discharge direction, the original is transported again to the reading position. The original is switched back in an upstream direction opposite to the discharge direction, and transported again to the reading position.

Arranged on the sheet supply path 16 are the feed rollers 26 for feeding an original; the transport roller 28 for transporting the original fed by the feed rollers 26; the separation member 29 for allowing the transport roller 28 to transport only the uppermost single original and preventing the second and subsequent original from being fed; and the pair of register rollers 30 for sending the original transported by the transport roller 28 further downstream after aligning leading edge thereof.

The feed rollers 26 and the transport roller 28 are interconnected to the sheet supply motor M1 via the one-way clutch OW1. Also, the register rollers 30 are interconnected to the sheet supply motor M1 via the one-way clutch OW2. Through this configuration, the sheet supply motor M1 rotates the feed rollers 26 and the transport roller 28 in the forward rotation and rotates the register rollers 30 in the reverse rotation.

To the transport path 17 are arranged the large transport roller 31 and a plurality of follower rollers 32, 33 and 34 pressing against the outer circumference of the transport roller 31. The transport roller 31 is driven in forward and in reverse by the transport motor M2.

The follower roller 36 that presses against the transport roller 31, and the pair of discharge rollers 37 that discharge the original to the discharge tray 11 are arranged on the discharge path 18. The discharge roller 37 is interconnected to the transport motor M2 that can rotate in forward and in reverse. Also, as described above, below the discharge path 18 is formed the switchback path 22.

In order to transport the original without hindrance when the leading and trailing edge of the original circulating via the circulating path 19 and the transport path 17 cross each other, the pair of switchback rollers 40 on the switchback path 22 is configured so that a solenoid SOL 3 separates one of the switchback rollers 40 from the other switchback roller 40. The switchback rollers 40 are interconnected to the sheet supply motor M1 that can rotate in forward and in reverse.

At a downstream side of the transport path 17 is arranged the switchback flapper 42 to guide the original to one of the discharge path 18 and the switchback path 22. The switchback flapper 42 is driven by a solenoid SOL 1. The switchback flapper is driven to the position (a) shown in the drawings when guiding the original to the switchback path 22, and is positioned at the position (b), or a home position, when guiding to the discharge path 18.

Also, at a downstream side of the switchback flapper 42 is arranged the first discharge flapper 45 that guides the original to one of the first circulating path 19 and the discharge roller 37. The first discharge flapper 45 is driven by a solenoid SOL 2. The first discharge flapper 45 is positioned at the position (a'), or a home position, shown in the drawings, when guiding an original to the discharge roller 37, and is driven to the position (b') when guiding an original to the first circulating path 19. At this time, the original is transported while being wound around the transport roller 31. Note that when the original has a length shorter than a width of the letter size (215.9 mm), the original is transported while being wound around the transport roller 31.

Above the discharge path 18 are arranged a retreat path 47 for allowing the trailing edge of the original to retreat, and a retreat path switching flapper 43 moving downwardly to allow the trailing edge of the original to pass therethrough. When the original is transported in a reverse direction from the transport path 17, the retreat path switching flapper 43 moves to the (a") position after the trailing edge of the original passes over the retreat path switching flapper 43, and guides the original to the retreat path 47.

A flexible Mylar sheet 48 is disposed at a joining portion of the transport path 17 and circulating path 19 for preventing the original from being transported to the circulating path 19 in the reverse direction. The flexible Mylar sheet 48 covers an outlet of the circulating path 19. When the original is transported from the circulating path 19 to the transport path 17, the original pushes the flexible Mylar sheet 48 upwardly to pass therethrough. When the original is transported in the reverse direction from the transport path 17, the original passes over the flexible Mylar sheet 48 and is transported into the retreat path 47.

In order to transport the original in the reverse direction to the retreat path 47 as described above, the trailing edge of the original needs to pass the retreat path 47 on the transport path 17. When the original is transported in the reverse direction to the retreat path 47, if the trailing edge of the original does not pass the retreat path 47, the transport roller 31 rotates in forward to transport the original toward a downstream side in the transport direction until the trailing edge of the original passes the retreat path 47.

After the trailing edge of the original passes the retreat path 47, the retreat path switching flapper 43 moves to the (a") position to guide the original transported in the reverse direction by the reverse rotation of the transport roller 31 to the retreat path 47.

Further, on the original tray 9 are arranged the length sensors S1 and S2 that detect the length of the original on the original tray 9, and the empty sensor S3 that detects the original. On the sheet supply path 16 is arranged the register sensor S4. On the transport path 17 is arranged the read sensor S5; on the switchback path 22 is arranged the switchback sensor S6; and on the discharge path 18 is arranged the discharge sensor S7. These sensors are connected to the control unit (control means). Also, the sheet supply path 16 and the transport motor M2 are connected to a transport control unit (not shown in the drawings). Also, the pressure solenoid SOL1, the solenoid SOL2 and the solenoid SOL3 are connected to the control unit. The control unit has a central processing unit (CPU) for controlling a process of transporting the original.

Based on the signal output from each of the sensors S1 to S7 and the image determining means, each of the motors M1 and M2 and the solenoids SOL1 to SOL3 are controlled to execute the original transport operation by the control unit. The discharge roller 37 is interconnected to the transport motor M2 that can rotate in only one direction.

Note that in this embodiment of the present invention, the switchback path 22 is disposed as described above. The leading and trailing edges of the original are switched in the path 22 to turn the original over from front to back. It is also possible to turn the original over from front to back by inverting the discharge path 18 and the discharge roller 37, without establishing the switchback path 22. Specifically, it is possible to configure a discharge roller that can rotate in both forward and in reverse and interconnect that to the discharge roller 37.

Through this configuration, the discharge rollers 37 are controlled to rotate in reverse while nipping the trailing edge of the original when reading in the duplex mode to read images on both sides of an original, so that the original is switched back and sent to the transport path 17 via the circulating path 19. It is also perfectly acceptable to configure the pair of discharge rollers 37 to use a pressing solenoid SOL to separate a discharge roller 37 from the other discharge roller 37, so that unhindered transport of the original is possible without the leading and trailing edges thereof pass each other when the original is circulated via the first circulating path 19 and the transport path 17. Specifically, the discharge path 18 and the paired discharge rollers 37 have a function to switchback the travel direction of the original from front to back.

Figure 3:
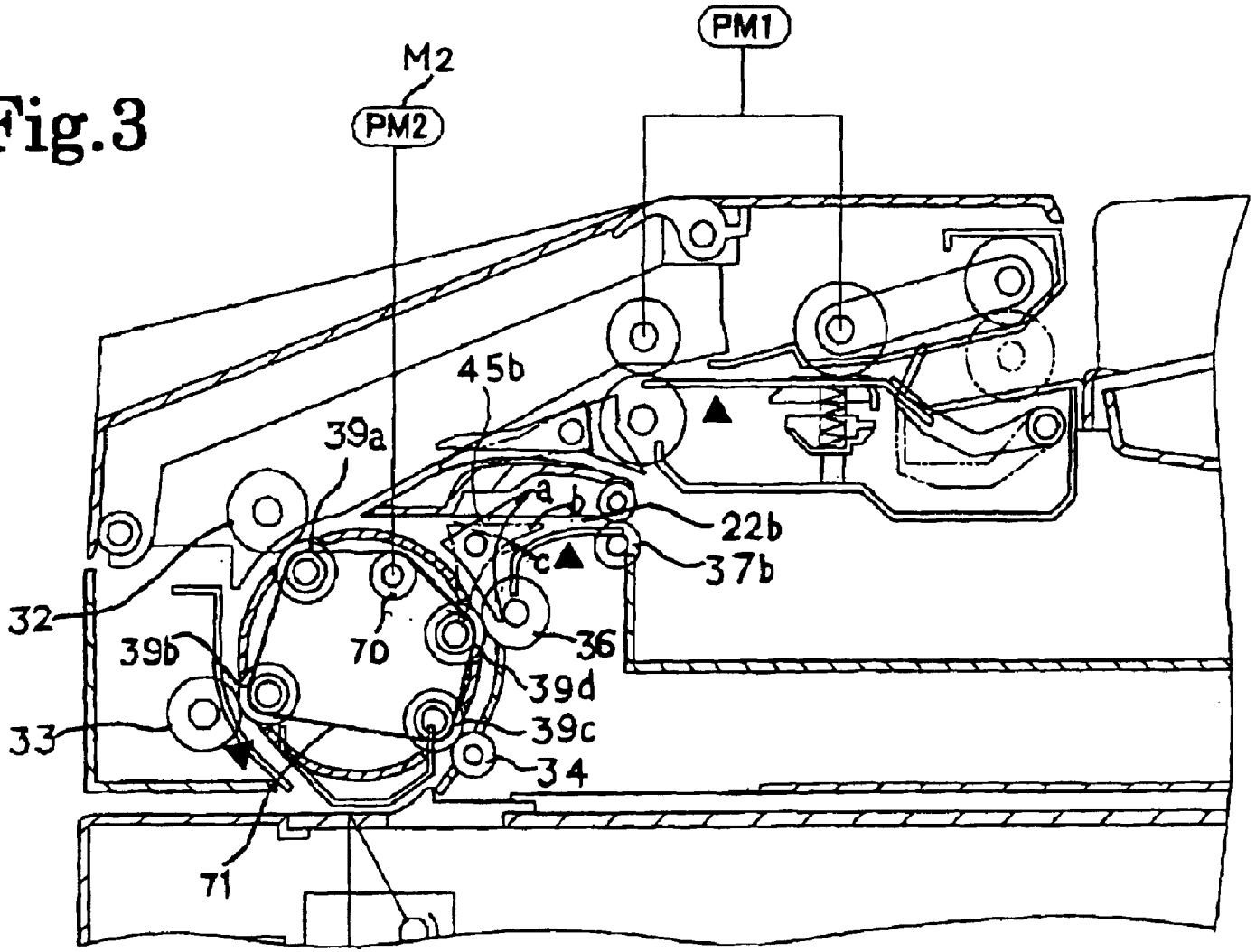
FIG. 3 is a view showing another original transport mechanism of an ADF according to the present invention.

The following will explain a reading device according to the second embodiment of the present invention. FIG. 3 shows an original transport mechanism of the ADF of the second embodiment. In the first embodiment shown if FIG. 2, the transport roller 31 is a large diameter roller.

As shown in FIG. 3, the transport roller in the second embodiment is provided with the transport rollers 39*a*, 39*b*, 39*c*, and 39*d* paired with the follower rollers of 32, 33, 34 and 36. The four transport rollers 39*a*, 39*b*, 39*c*, and 39*d* are driven by forward and reverse rotations of the transport motor M2 via the belt 71 trained around a drive shaft 70 and the four transport rollers 39*a*, 39*b*, 39*c*, and 39*d*.

The four transport rollers 39*a*, 39*b*, 39*c*, and 39*d* are configured to press against the paired follower rollers of 32, 33, 34 and 36. The discharge flapper 45*b* is positioned at (a') when a small original is wound around for transport, and at (b') when the original is discharged, as shown in FIG. 3, to guide the original to the circulating path 19, or the discharge tray 11.

Note that the second embodiment has the configurations same as those in the first embodiment other than the configuration of the transport rollers 39*a*, 39*b*, 39*c*, and 39*d*, and the switchback path 22*b*, or the discharge outlet as described above, so that the descriptions thereof are omitted.

The following will describe a process of determining a size of the original. At first, the first method of determining an original size uses the two length detection sensors S1 and S2 disposed on the original tray 9 and the empty sensor S3 that detects the originals on the original tray 9.

When the length detection sensors S1 and S2 are off and only the empty sensor S3 is on, it is determined that the length of the original is shorter than a width of the A4 size. When the length detection sensors S1 is off and the length detection sensors S2 and the empty sensor S3 are on, it is determined that the length of the original is shorter than a length of the A4 size. Further, when the length detection sensors S1 and S2 and the empty sensor S3 are on, it is determined that the length of the original is longer than a length of the B4 size.

When the original is sent to the sheet supply path 16, the register sensors S4 arranged at an upstream side of the register rollers 30 determine the width of the original. The register sensors S4 are arranged at plural positions in the width direction of the original on the sheet supply path 16 to determine the length of the original in the width direction through on/off of each sensor. The size of the original is determined according to the detection of the length of the original in the transport direction and the width direction.

The second method of determining the original size uses the two length detection sensors S1 and S2 disposed on the original tray 9 and the empty sensor S3 that detects the originals on the original tray 9. When the length detection sensors S1 and S2 are off and only the empty sensor S3 is on, it is determined that the length of the original is shorter than a width of the A4 size. When the length detection sensors S1 is off and the length detection sensors S2 and the empty sensor S3 are on, it is determined that the length of the original is shorter than a length of the A4 size. Further, when the length detection sensors S1 and S2 and the empty sensor S3 are on, it is determined that the length of the original is longer than a length of the B4 size.

A plurality of register sensors S4 is arranged in the width direction of the original on the sheet supply path 16 at an upstream side of the register rollers 30, and determines the width of the original with the first method. In the second method, a slide volume (variable resistor), not shown in the drawings, is interconnected to the movement of the movable side plate 13 (see FIG. 1) in the width direction to regulate the side edges of the original, and rotates to determine the size of the original. The size of the original is determined according to the detection of the length of the original in the transport direction as described above, and the detection of the width of the original by the slide volume (variable resistor).

In the third method of determining the original size, the length of the original in the transport direction is determined to be shorter than a width of the A4 size when the register sensor S4 detects the trailing edge of the original (the state in which the register sensor S4 is off), and longer than a width of the A4 size when the register sensor S4 turns on, after the register rollers 30 transports the original for a predetermined distance to the read sensor S5.

A slide volume (variable resistor), not shown in the drawings, is interconnected to the movement of the movable side plate 13 in the width direction to regulate the side edges of the original, and is used to detect the width of the original. The size of the original is determined according to the detection of the length of the original in the transport direction using the register sensor S4 as described above, and the detection of the width of the original by the slide volume (variable resistor).

In the fourth method of determining the original size, the length of the original in the transport direction is determined to be shorter than a width of the A4 size when the register sensor S4 detects the trailing edge of the original (the state in which the register sensor S4 is off), and longer than a width of the A4 size when the register sensor S4 turns on, after the register rollers 30 transports the original for a predetermined distance to the read sensor S5. The register sensor S4 arranged at an upstream side of the register rollers 30 determines the width of the original.

The register sensors S4 are arranged at plural positions in the width direction of the original on the sheet supply path 16, and determine the width of the original through on or off of each sensor. The size of the original is determined according to the detection of the length of the original in the transport direction and the width of the original.

Note that to determine the size of the original, the four methods are available as described above. In this embodiment of the invention, the first method is employed. The other methods can also be employed. Furthermore, it is also perfectly acceptable to use an input from an operation panel on an external device or through an input from a personal computer to determine the size of the original.

The following will describe an image reading method according to the present invention. At first, the following will explain a method for determining whether the image to read is a black and white image or a color image.

Figure 4:
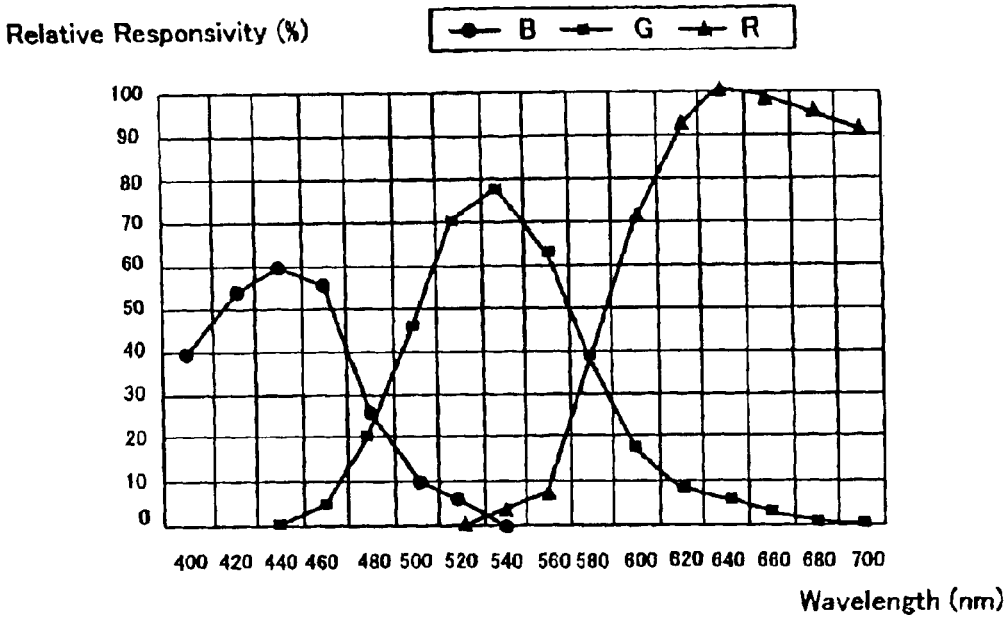
FIG. 4(*a*) is a graph showing a relationship between relative sensitivity and a wavelength of color for each sensor, and FIG. 4(*b*) is a graph showing spectral reflectance data of a monotone original.
Figure 4:
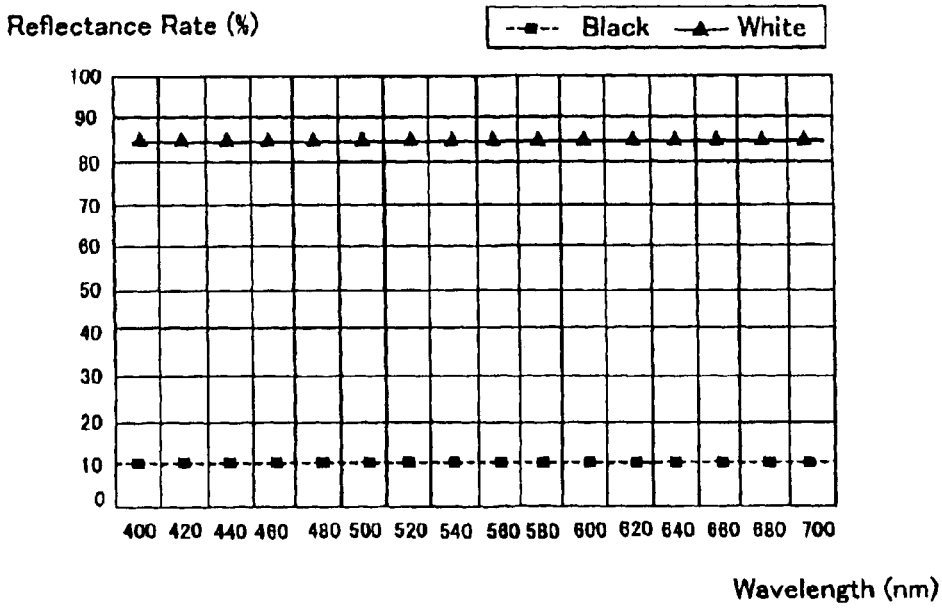

FIG. 4(*a*) is a graph showing a relationship between relative sensitivity and a wavelength of color for each sensor, and FIG. 4(*b*) is a graph showing spectral reflectance data of a monotone original. As shown in FIG. 4(*a*), since each line sensor, R, G, and B, has a spectral sensitivity peak at a different wavelength in the reading level of the sensors, each line sensor generates an output peak value at different wavelengths when reading color originals.

On the other hand, as shown in FIG. 4(*b*), a monotone (black and white) original shows a constant spectral reflectance rate regardless of the wavelength. In the figure, each line sensor generates a constant high output for white pixels and a constant low output for black pixels. Because of this difference, it is possible to determine whether an original to be read is either in color or black and white.

Note that because it is possible to determine the image by checking the peak wavelength of the line sensor output, even when reading the original at high speed in the black and white mode, this operation is possible.

In this way, the color detection unit in this invention is configured to receive an output from a shaded correction unit converted into a digital signal at the red, green and blue line sensors. When a difference is detected in the output color patterns from the sensors, it is determined to be a color original. Conversely, when there is no difference, it is determined to be a black and white original.

In this embodiment of the invention, an image-signal control apparatus (the control unit) is provided with a data memory unit 107 (see FIG. 5 and FIG. 6) to sequentially store image data read by the reading means. Depending on the type of image reading apparatus, it is possible to output image data from the reading means to an image forming apparatus without a data memory to store the image data after processing correction of the image data. In such a case, the determining means uses the processed signal of the image data from the reading means to determine whether the image data is black and white or color.

Figure 5:
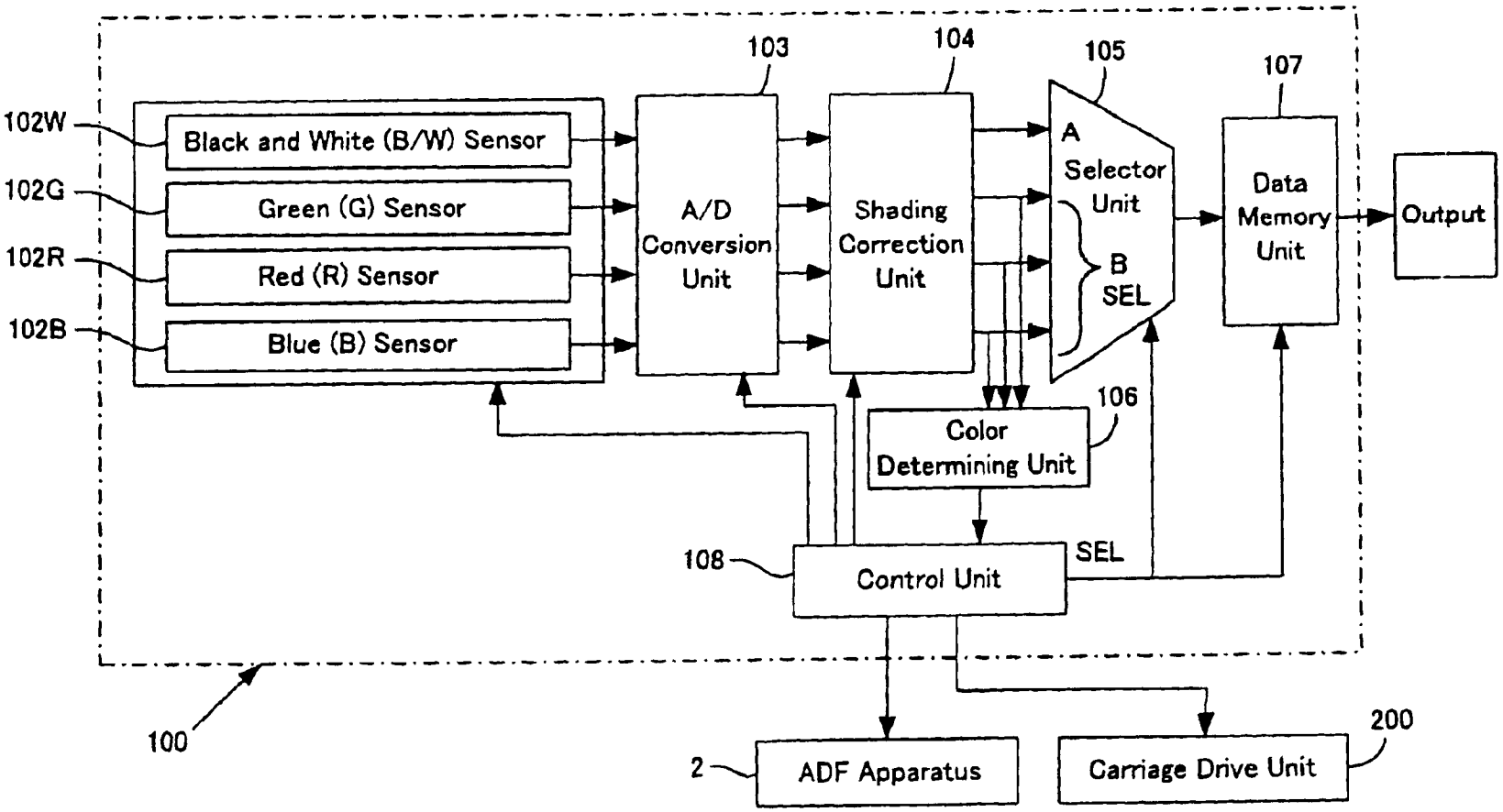
FIG. 5 is a circuit diagram of an image signal control unit with four line sensors including a black and white sensor.

FIG. 5 shows a circuit configuration of a control apparatus 100 having four line sensors, namely three line sensors of red (R), green (G), and blue (B), and a black and white (B/W) sensor. The control apparatus 100 shown in FIG. 5 includes an A/D conversion unit 103 to convert analog data read by the four line sensors 102W, 102R, 102G and 102B into digital data; and a shading correction unit 104 for correcting shading of the converted data (sensitivity correction between photoelectric conversion elements).

The control apparatus 100 also comprises a color detection unit 106 for determining a gradation of the shading corrected data; a control unit 108 for receiving a result determined by the color detection unit and output a signal to control the image reading apparatus; a color selector unit 105 for switching and output monotone data or color data according to a SEL signal from the control unit 108; and a data memory unit 107 for storing the image data after switching between a monotone mode and a color mode according to the SEL signal from the control unit 108 and outputting it to an image forming apparatus.

In the control circuit shown in FIG. 5, image data from the black and white sensor 102W are used as image data in the first reading mode (the monotone reading mode). At the same time, it is determined whether it is a color original based on the output from the green sensor 102G, the red sensor 102R and the blue sensor 102B.

Figure 6:
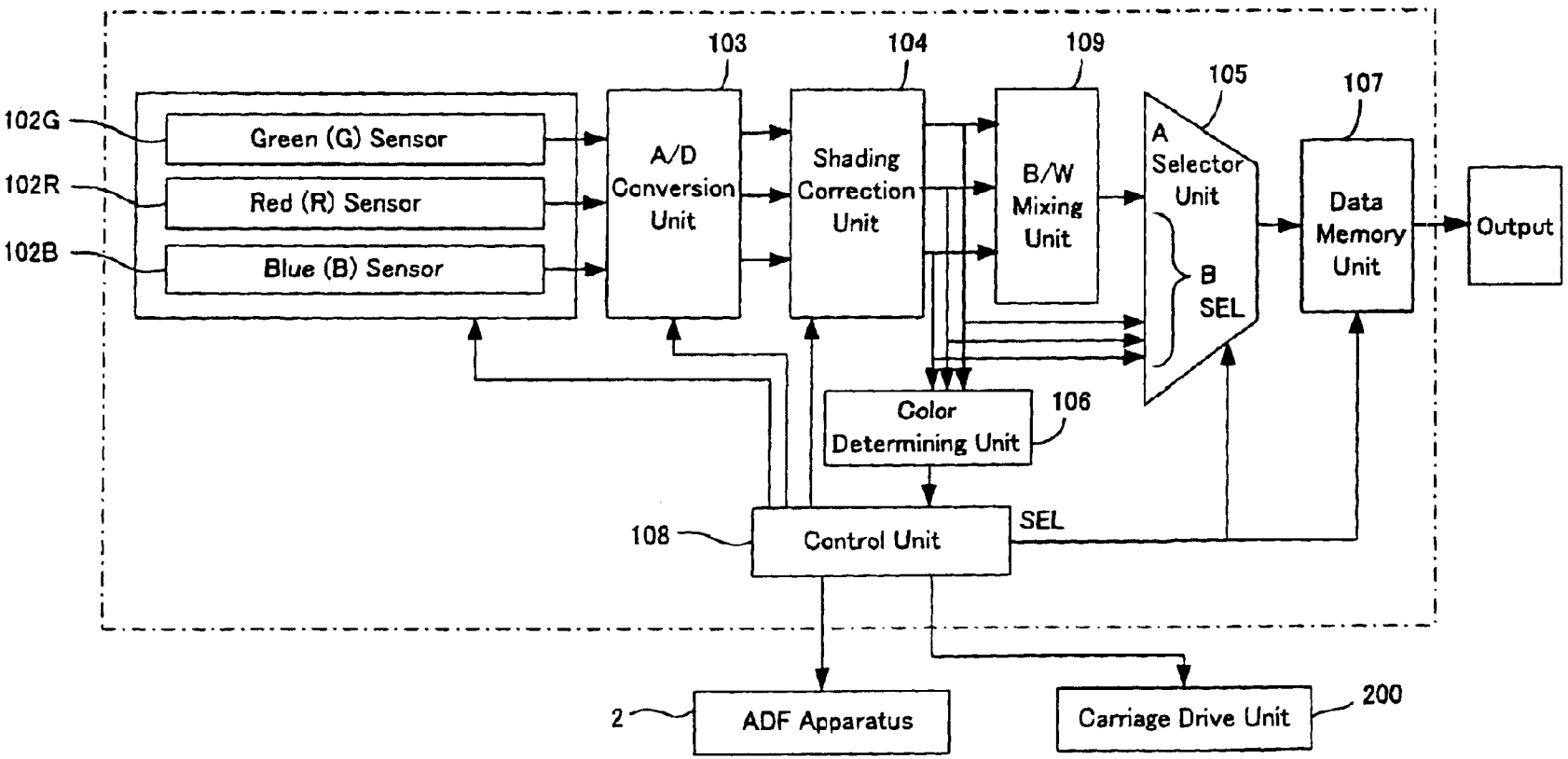
FIG. 6 is a circuit diagram of an image signal control unit with three line image sensors.

FIG. 6 shows the image-signal control unit 100*b* that uses the three line sensors of red (R), green (G) and blue (B). The image-signal control unit 100*b* comprises the line sensors 102R, 102G and 102B; an A/D conversion unit 103 for converting analog data read by the three line sensors; a shading correction unit 104 for correcting shading of the converted data; a monochrome conversion unit 109 for generating black signals based on the shading corrected data; a color detection unit 106 for determining a gradation of the shading corrected data; and a control unit 108 for receiving a result determined by the color detection unit and output a signal to control the image reading apparatus.

The image-signal control unit 100*b* also includes a color selector unit 105 for switching and output monotone data or color data according to a SEL signal from the control unit 108; and a data memory unit 107 for storing the image data after switching between a monotone mode and a color mode according to the SEL signal from the control unit 108 and outputting it to an image forming apparatus.

With the configuration described above, in the control circuit shown in FIG. 6, the image data in the first reading mode (the monochrome mode) becomes AND values of the output from the green (G), red (R) and blue (B) line sensors. Based on whether there is a difference in the output patterns from the green sensor 102G, the red sensor 102R and the blue sensor 102B, it is possible to determine whether the original is in color or black and white.

Figure 7:
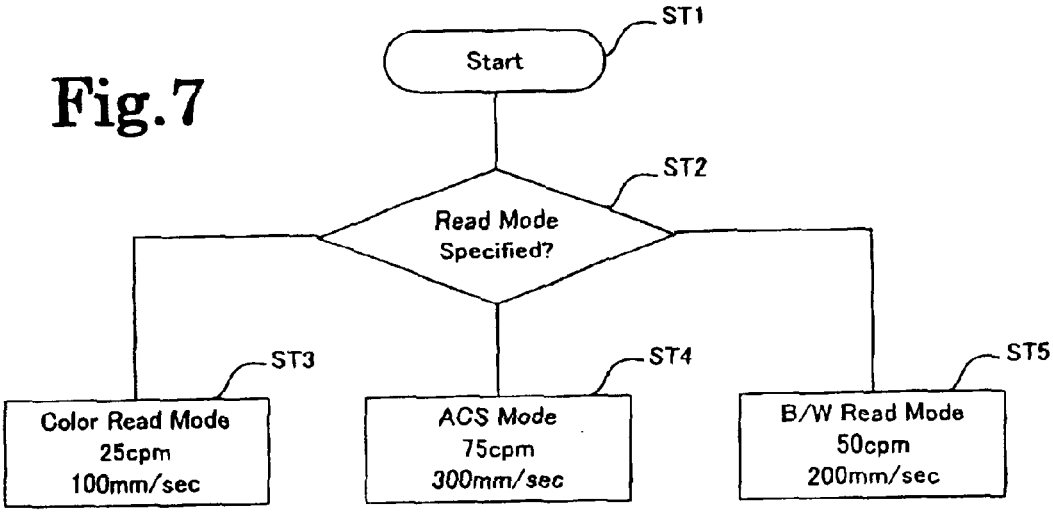
FIG. 7 is a flow chart showing a process of setting a reading mode of the image reading apparatus.

FIG. 7 shows a flowchart of a process of setting a reading mode. In FIG. 7, when the image reading device starts to read the original (ST1), the operator sets the reading mode (ST2) When the color reading mode is set (ST3), the image reading apparatus reads the images at a low speed in the color reading mode (100 mm/sec). If the black and white reading mode is set (ST5), the image reading apparatus reads the images at a high speed in the black and white mode (200 mm/sec). When an auto-color select (ACS) mode is set (ST4), the images are read according to the high speed ACS reading mode (300 mm/sec).

Figure 8:
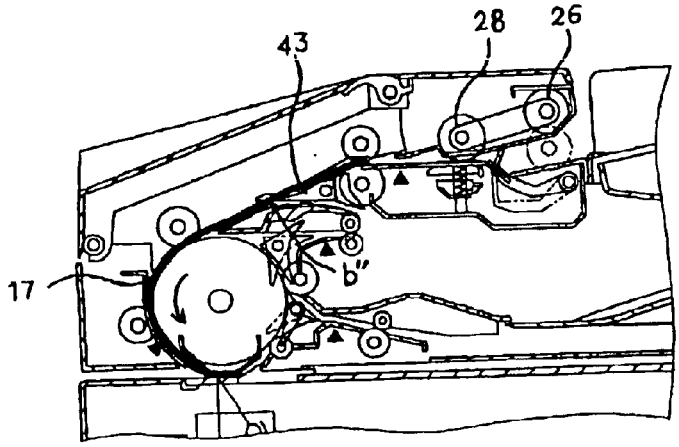
FIGS. 8(*a*)–8(*c*) are side views of a transport mechanism for transporting an original.
Figure 8:
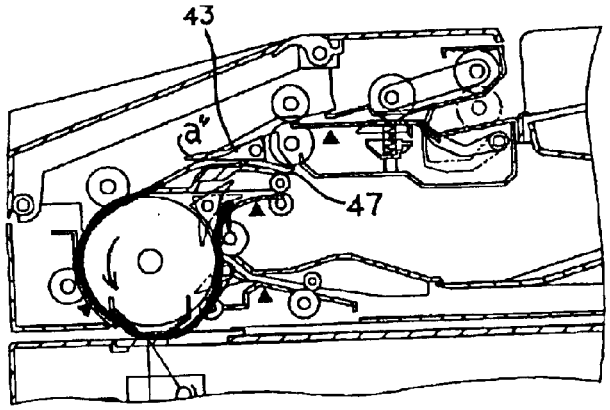
Figure 8:
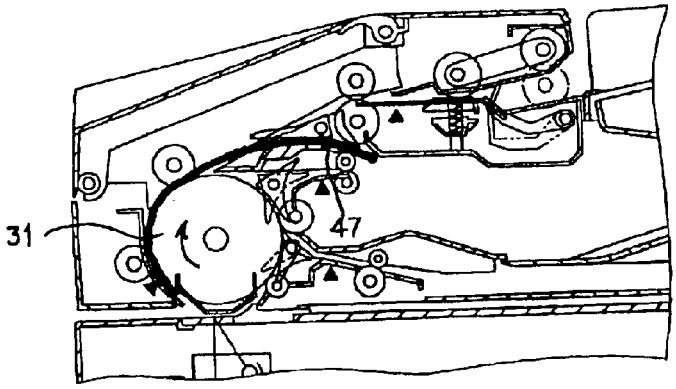

The following will describe an operation of transporting the original for reading according to the embodiment of the instant invention. FIGS. 8(*a*)–8(*c*) to FIGS. 13(*a*)–13(*c*) are side views showing operations from transporting the original to discharging the original in the original transport apparatus 1. First, FIGS. 8(*a*)–8(*c*) and FIGS. 9(*a*)–9(*b*) show the operation of reading a single side of the original, in which the original is returned to the retreat path and is then read in a determined reading mode after determining whether the original has a black and white image or color image.

In FIG. 8(*a*), the discharge roller 26 is lowered to pick up the original on the original tray 9. The original is separated into a single sheet by the sheet supply roller 28 and is then transported to the transport path 17. In this step, a reading speed is 300 mm/sec, and the retreat path switching flapper 43 is moved to the (b") position while the color determination is being performed.

In FIG. 8(*b*), when the original is determined to have a color image, it is confirmed that the trailing edge of the original passes the retreat path 47, and the retreat path switching flapper 43 moves to the (a") position.

In FIG. 8(*c*), the discharge roller 31 starts to rotate in reverse, thereby transporting the original in a reverse direction into the retreat path 47. The original is returned until the leading edge of the original is at an upstream side of the reading position, then the discharge roller 31 stops rotating. Note that the original is transported into the retreat path at a speed higher than the reading speed for the determination, i.e. 300 mm/sec. In this embodiment, the maximum reverse transport speed is 360 mm/sec. It is preferred to set the maximum speed as high as possible to increase the overall processing speed as far as the original is not damaged.

Figure 9:
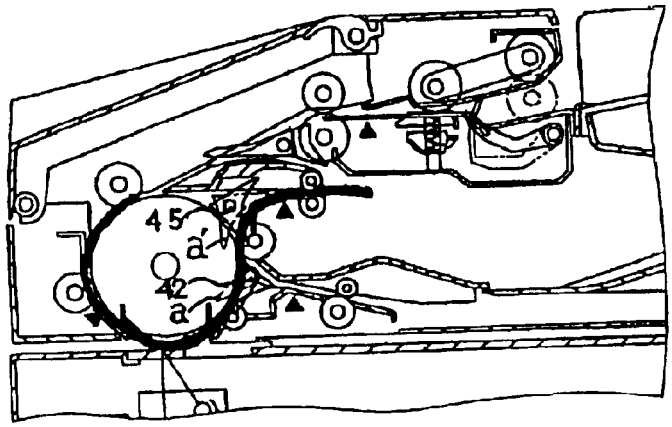
FIGS. 9(*a*) and 9(*b*) are side views of a transport mechanism for transporting an original.
Figure 9:
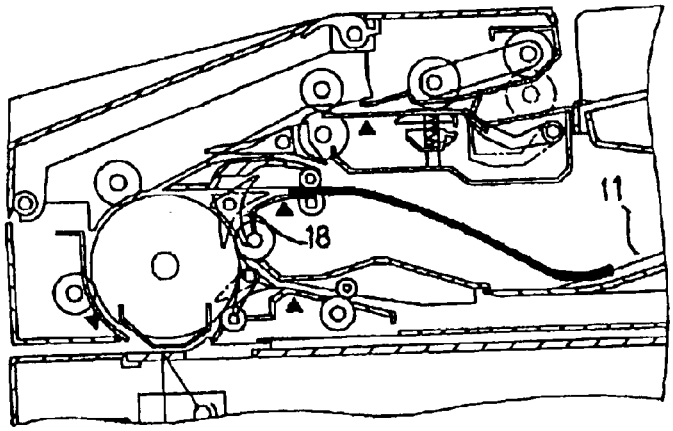

In FIG. 9(*a*), the original is read in a reading mode according to the result of the determination in the step shown in FIG. 8(*b*). At this time, the switchback flapper 42 is moved to the (a) position, and the discharge flapper is moved to the (a') position. The original is then read while being transported at a speed of 100 mm/sec, when the original contains color images. In FIG. 9(*b*), after the original is completely read, the original is discharged to the discharge tray 11 via the discharge path 18.

Figure 10:
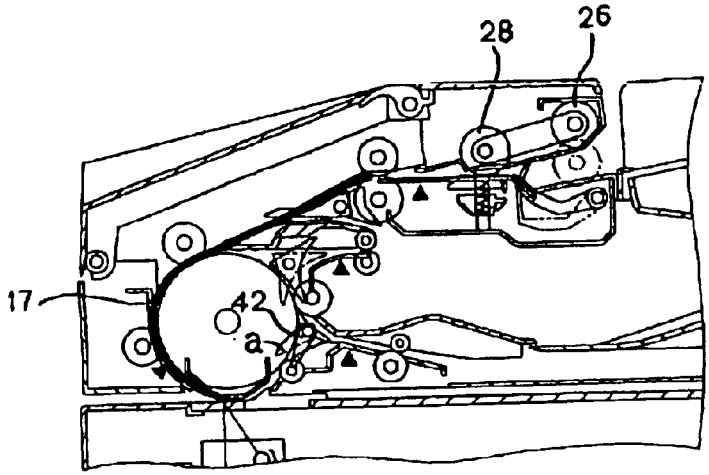
FIGS. 10(*a*)–10(*c*) are side views of a transport mechanism for transporting an original.
Figure 10:
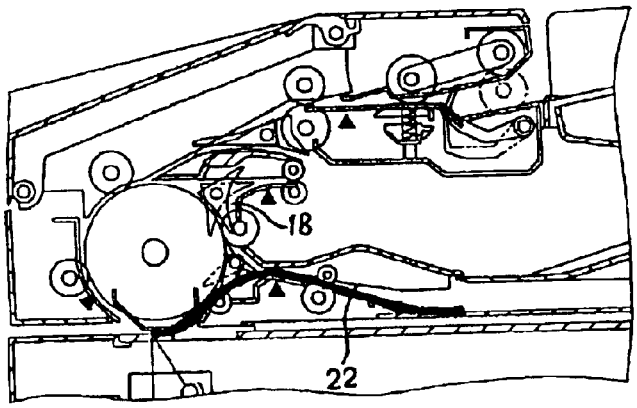
Figure 10:
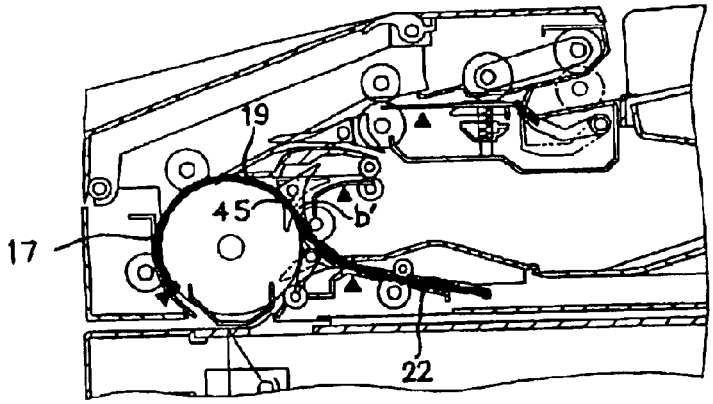

The following will describe the operations of reading both sides of an original. FIGS. 10(*a*)–10(*c*) to FIGS. 13(*a*)–13(*c*) are side views of the operations of reading both sides of the original.

As shown in FIG. 10(*a*), the original on the original tray 9 is separated into a single sheet by the feed rollers 26 and the sheet supply roller 28, and the single sheet is then transported to the transport path 17. The switchback flap 42 is moved to the (a) position. The pre-scanned original is then transported to the switchback path 22. The color determination of the original is performed at this time.

Note that at the point when the color of the original is determined, the transport roller 31 rotates in reverse as described above, when the trailing edge of the original passes a predetermined position on the retreat path 47 to transport and guide the trailing edge of the original into the retreat path 47. The original is returned until the leading edge of the original is at an upstream side of the reading position, then the discharge roller 31 stops rotating. The reverse speed is set in the same way as in FIG. 8(*c*).

The following will describe the operations of switching back the original to read the both sides thereof after the trailing edge of the original passes through a predetermined position.

In FIG. 10(*a*), the original is fed from the original tray 9 and transported to the reading position. The original is read to determine whether the original is in black and white or contains a color image. In FIG. 10(*b*), in a case that the original is read and determined up to the trailing edge, the original is transported to the switchback path 22. The trailing edge of the original passes through the reading position. In FIG. 10(*c*), the original is transported from the switch-back path 22 to the transport path 17 via the circulating path 19. At this time, the first discharge flapper 45 is moved to the (b') position.

Figure 11:
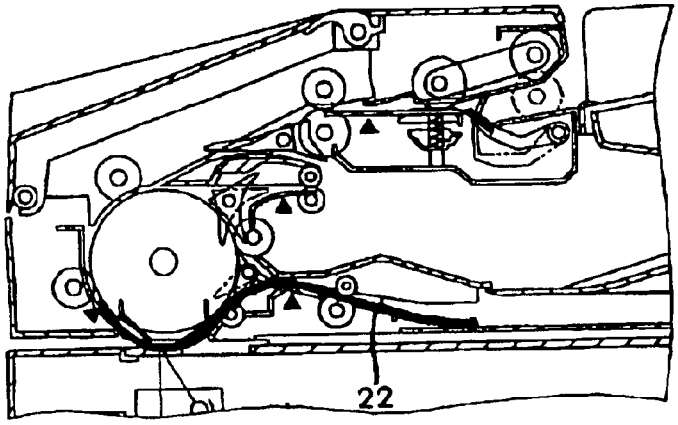
FIGS. 11(*a*)–11(*c*) are side views of a transport mechanism for transporting an original.
Figure 11:
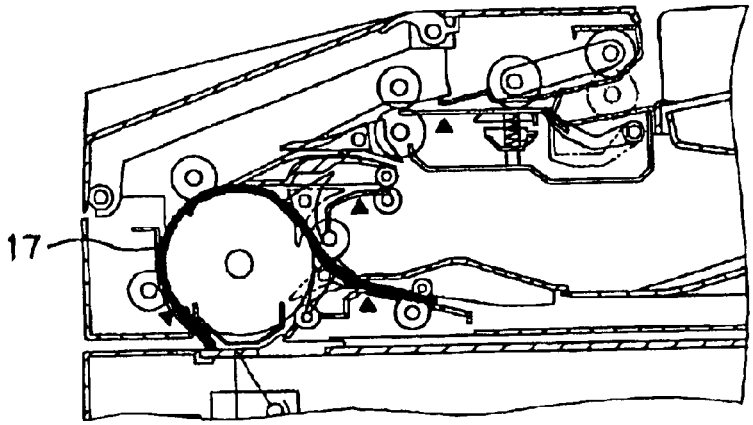
Figure 11:
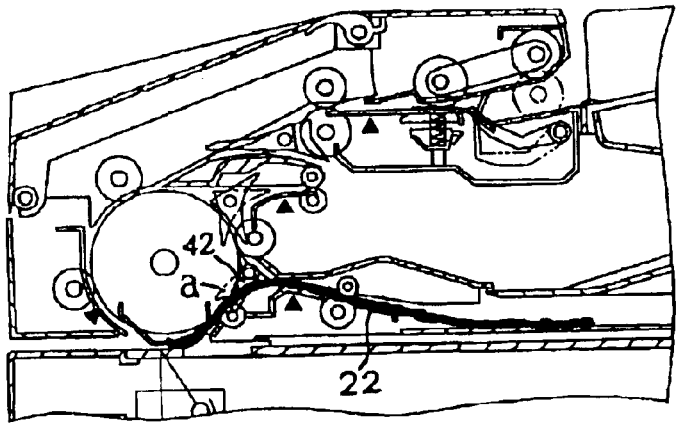

In FIG. 11(*a*), the original is transported to the switchback path 22 again. This time, the original is not read at the reading position. In FIG. 11(*b*), the original is transported to the reading position again via the transport path 17. The original is then read in a reading mode according to the result of the determination shown in FIG. 10(*a*). In FIG. 11(*c*), after the front side is read, the original is then transported to the switchback path 22 to turn over from front to back.

Figure 12:
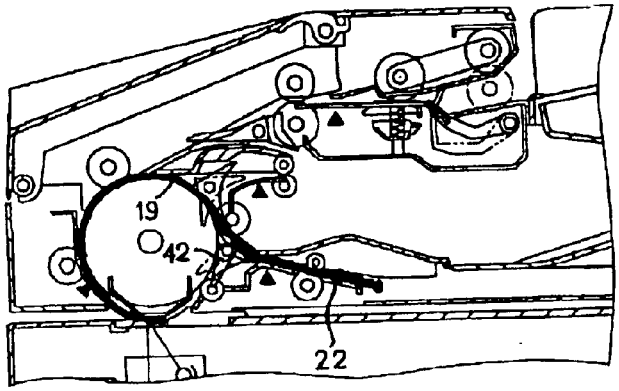
FIGS. 12(*a*)–12(*c*) are side views of a transport mechanism for transporting an original.
Figure 12:
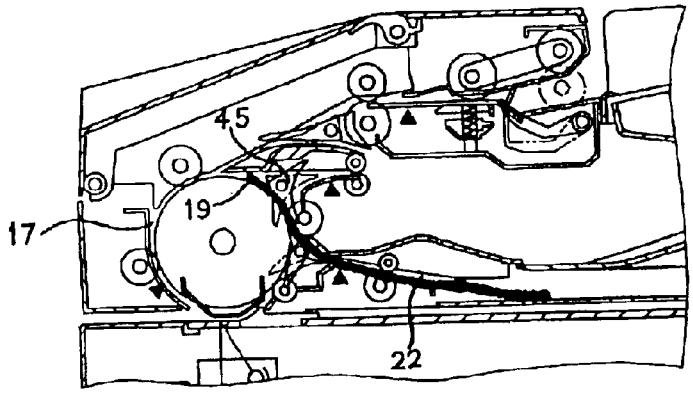
Figure 12:
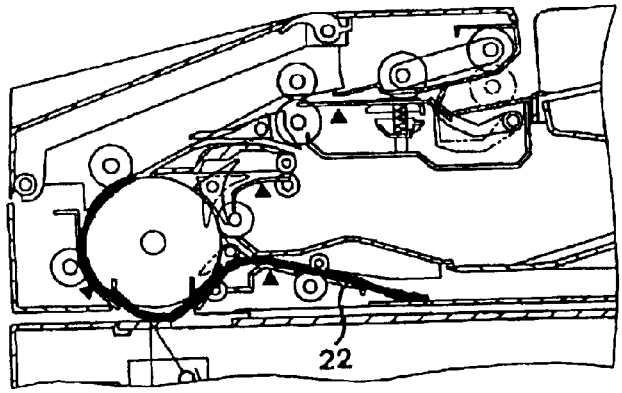

In FIG. 12(*a*), the original is transported from the switchback path 22 to the transport path 17 via the circulating path 19. The pre-scanned original is then transported to the switchback path 22. The color determination of the original is performed at this time. The switchback flap 42 is moved to the (a) position. In a case that the original is read and determined up to the trailing edge, the original is transported to the switchback path 22. In FIG. 12(*b*), the original is transported from the switchback path 22 to the transport path 17 via the circulating path 19. Here, the original is turned over from front to back. At this time, the first discharge flapper 45 is moved to the (b') position. In FIG. 12(*c*), the original is transported to the switchback path 22 again. This time, the original is not read at the reading position.

Figure 13:
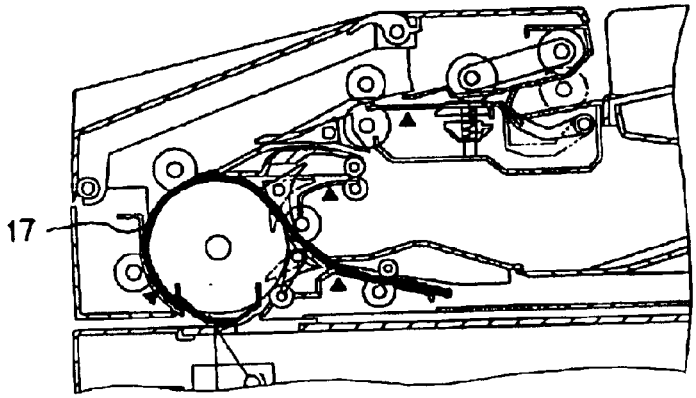
FIGS. 13(*a*)–13(*c*) are side views of a transport mechanism for transporting an original.
Figure 13:
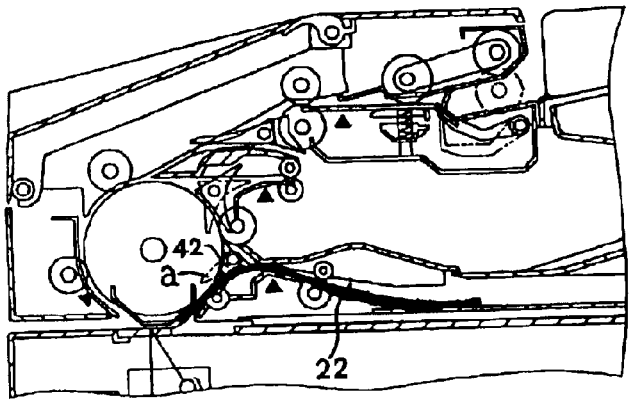
Figure 13:
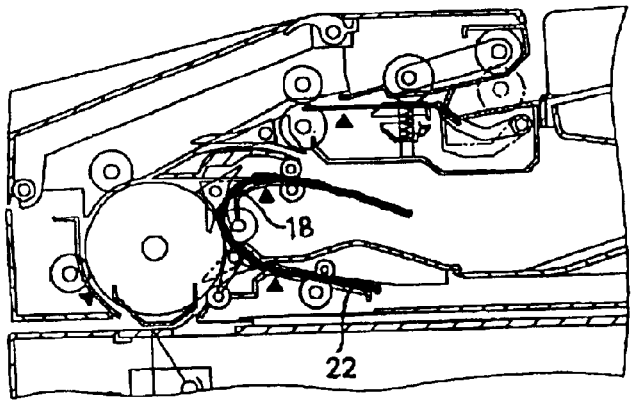

In FIG. 13(*a*), the original is transported to the reading position again via the transport path 17. The backside of the original is then read in a reading mode that corresponds to the result of the determination shown in FIG. 12(*a*). In FIG. 13(*b*), after the backside is read, the original is then transported to the switchback path 22 to turn over from back to front. The switchback flap 42 is moved to the (a) position. In FIG. 13(*c*), after the page order is arranged, the original is discharged from the switchback path 22 to the discharge tray 11 via the discharge path 18. The same operations from FIG. 10(*a*) are repeated to read the next original.

The following will describe a process of reading the original according to the present embodiment with reference to the flow charts. FIG. 14 to FIG. 17 are flow charts showing a flow of the process.

Figure 14:
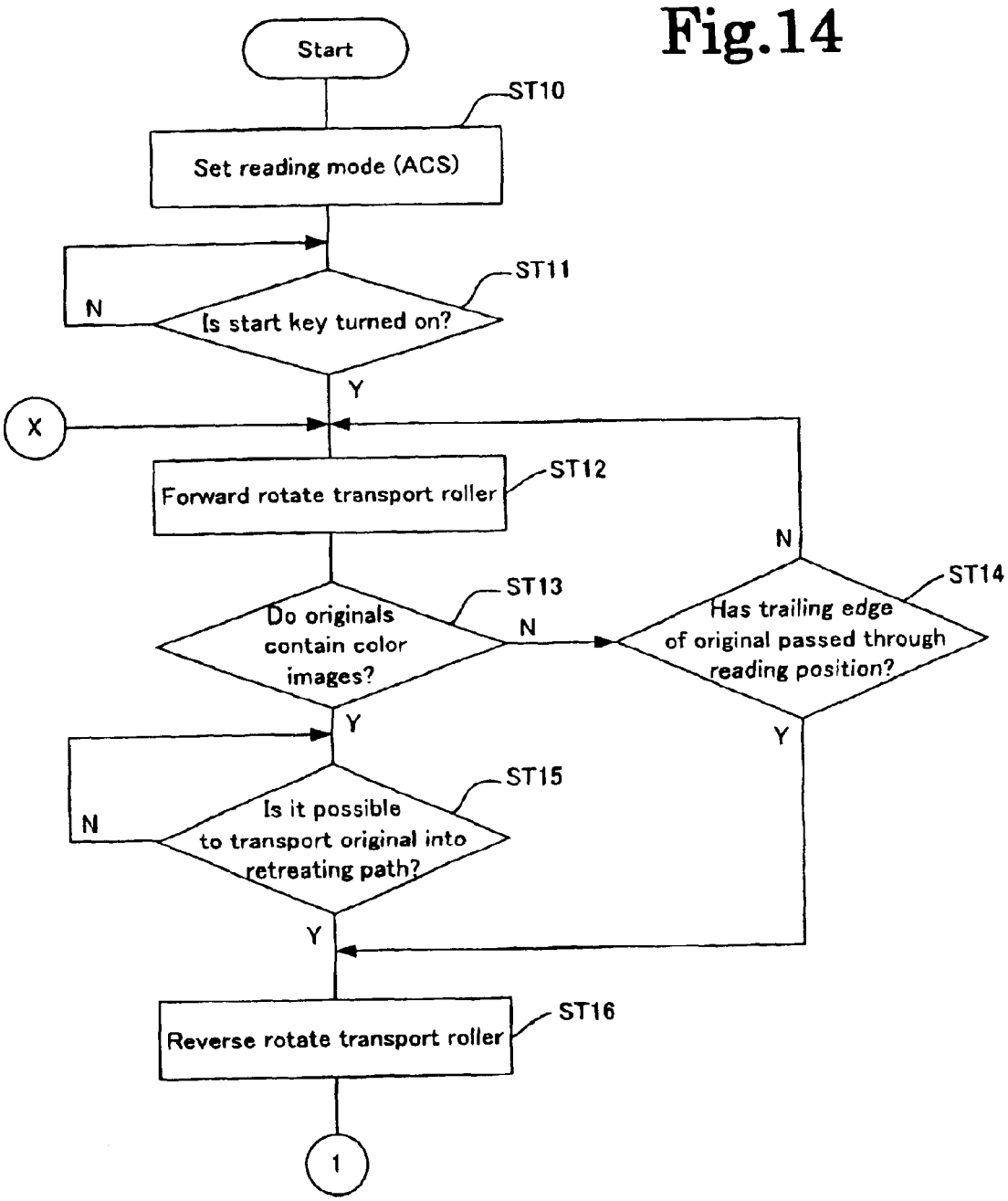
FIG. 14 is a flow chart of a process of reading one side of an original.
Figure 15:
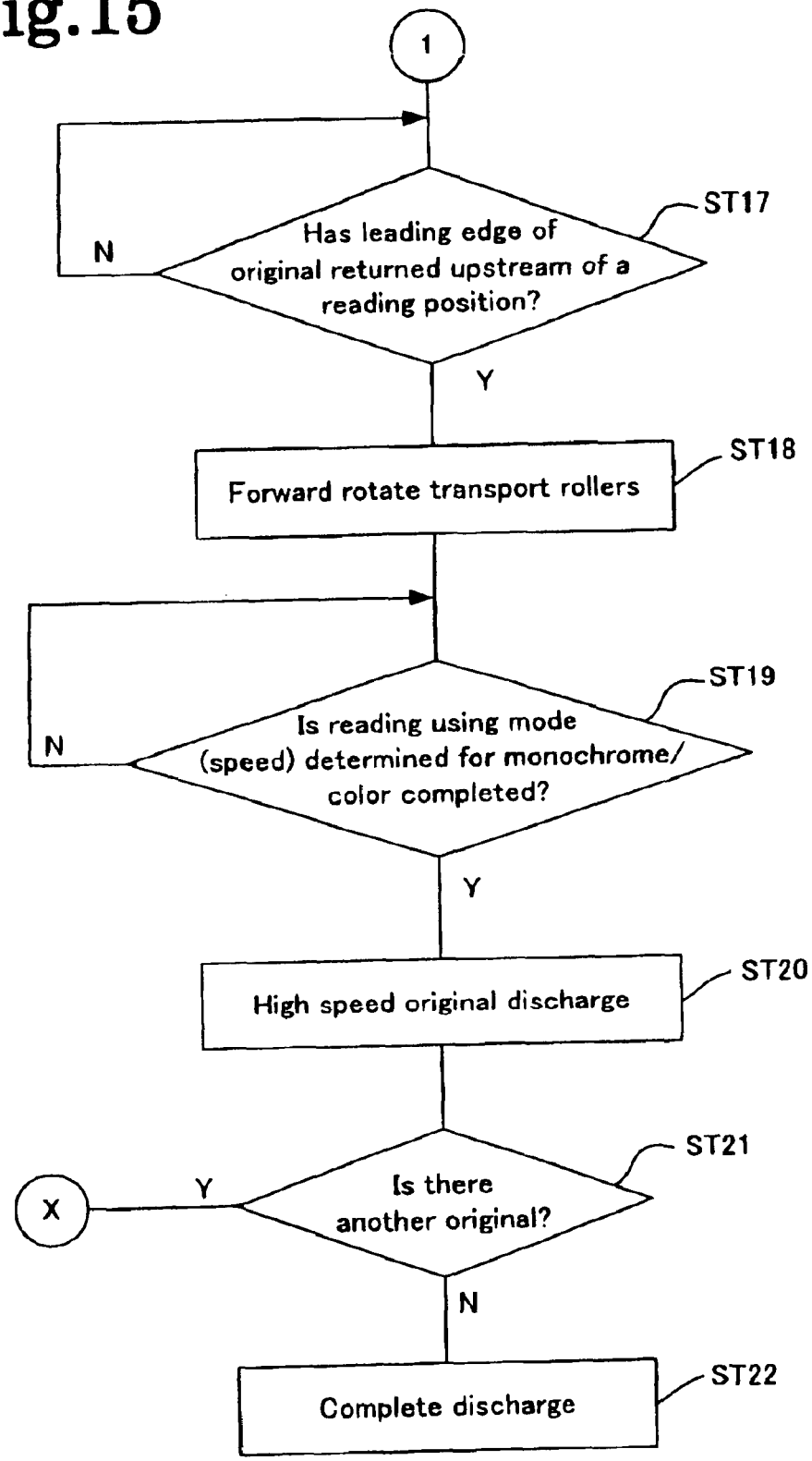
FIG. 15 is a flow chart of the process of reading one side of an original.

FIG. 14 and FIG. 15 are flow charts showing a process of returning all of the pre-scanned, single-sided originals to the retreat path 47. The following will describe the flow chart as an example of reading the original in the ACS reading mode. The reading mode is set to be the ACS reading mode (ST10). First, an operator presses the start key (ST11) to start the forward rotation of the transport roller (ST12).

A pre-scan is executed at a high reading speed (300 mm/sec) to determine whether the original has a color image (ST13). It is determined if the original can be transported into the retreat path 47 (ST15) when the original is determined to have a color image. When the original can be transported to the retreat path 47, the transport roller 31 starts to rotate in reverse (ST16). The retreat path switching flapper 43 at this time is moved to the (b") position.

If the original is determined to contain no color image (that the original is black and white), the determination process is continued up to the trailing edge of the original, and the transport roller 31 starts to rotate in reverse (ST16)

after the trailing edge of the original passes through the reading position (when the determination is completed) (ST14).

When the trailing edge of the original is detected to return to an upstream side of the reading position (FIG. 15 (ST17)), the transport roller 31 stops, and then rotates in the forward direction (ST18). The original is read in a reading mode (the reading speed) according to the result of the determination (ST19). When the original is read, the original is discharged to the discharge tray 11 at a high speed (ST20). Until all the originals are read (ST21), the reading process is repeated from step 12 (ST12).

The following will describe the process of switching the retreat path 47 and the switchback path in reading the single-side original according to a position of the trailing edge of the original when the determination result is obtained.

Figure 16:
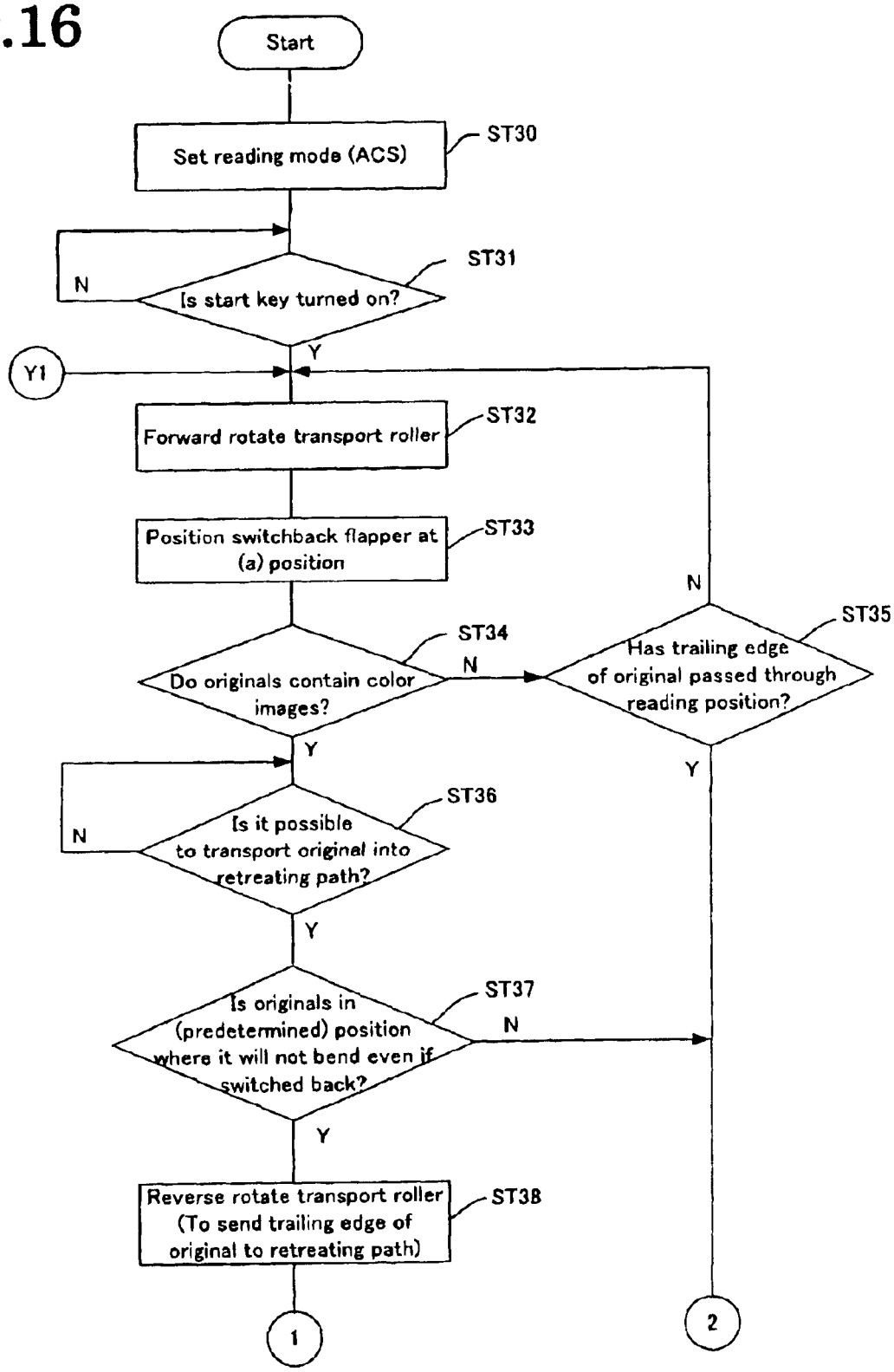
FIG. 16 is a flow chart of a process of reading both sides of an original.
Figure 17:
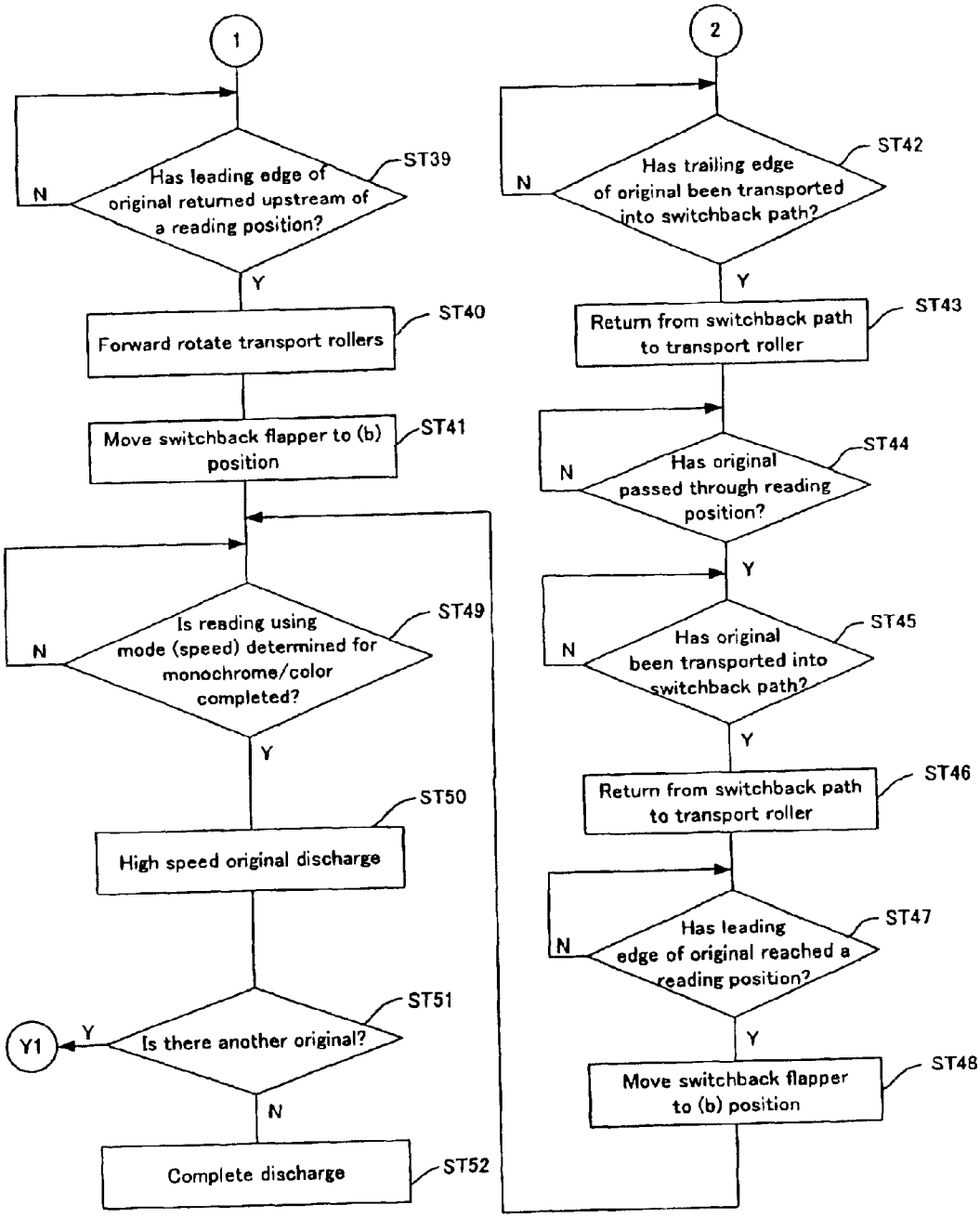
FIG. 17 is a flow chart of the process of reading both sides of an original.

Initially, the process of reading the original in the ACS mode will be explained with reference to the flow charts shown in FIG. 16 and in FIG. 17. The reading mode is set to be the ACS reading mode (ST30). First, an operator presses the start key (ST31) to start the forward rotation of the transport roller (ST32). The switchback flap 42 is moved to the (a) position (ST33).

A pre-scan is executed at a high reading speed (300 mm/sec) to determine whether the original has a color image (ST34). It is determined if the original can be transported into the retreat path 47 (ST36) when the original is determined to have a color image. When it is possible to transport the original and the original is at a (predetermined) position where the original does not bend (ST37), the transport roller 31 starts rotating in reverse (ST38). The trailing edge of the original is transported into the retreat path.

When the trailing edge of the original is detected at an upstream side of the reading position (ST39), the transport roller 31 stops, and rotates in the forward direction (ST40). The switchback flap 42 is moved to the (b) position (ST41).

On the other hand, if the original is determined to be in black and white, the original is transported into the switchback path 22 and determined up to the trailing edge. After the trailing edge of the original passes through the reading position (ST35), and is transported into the switchback path 22 (ST42), the original is returned to the transport roller 31 from the switchback path 22 (ST43) and transported from the transport path 17 to the reading position.

When the original passes through the reading position (ST44), the original is transported again into the switchback path 22 (ST45). At this time, the original is not read. The original is returned from the switchback path 22 to the transport roller 31 (ST46), and transported to the reading position via the transport path. When the leading edge of the original reaches the reading position (ST47), the switchback flapper 42 is moved to the (b) position (ST48).

The original is read in a reading mode (the reading speed) that corresponds to the result of the determination (ST49) When the original is read, the original is discharged to the discharge tray 11 at a high speed (ST50). If there is another original, the reading processes from step 32 (ST32) are repeated.

As described above, according to the present invention, the image reading apparatus comprises the transport path for guiding the original from the original tray to the reading position; the transport means capable of transporting the original at the reading position toward a downstream side in the forward direction or toward an upstream side in the reverse direction; the reading means for reading the original at the reading position; determining means for determining whether the original read by the reading means is in black and white or has color images; and the retreat path disposed at an upstream side of the reading position for retreating at least a part or all of the original from the transport path. The apparatus transports the original determined by the determining means in the reverse direction. After the original retreats to the retreat path, the original is transported to the reading position, so that the original is read in a reading mode according to the result of the determination. When the original contains both black and white and color images, the original passes through the reading position at a high speed for the determination. The original transport device transports the original to the retreat path and returns the original to the reading position, or transports the original via the circulating path for the turnover to prevent damage to the original according to the position of the original when the determination result is obtained.

Through this configuration, in original reading apparatus of the present invention, the reading means can read the original to determine whether the original contains color images without returning the original to the original tray. Also, after the original is determined to contain color images, the original can be read quickly according to the determination result without turning over the original, thereby increasing the overall reading speed.

Further, in the invention, in the case that the original is easy to bend when the original is returned to the original tray after the original is determined up to the trailing edge, the original is transported in the reverse direction according to the position of the original when the original is determined to include color images. Alternatively, the original is transported to the circulating path to turn over and is returned to the reading position. Therefore, it is possible to prevent damage on the original and perform the reading process at a high speed.

While the invention has been explained with reference to the specific embodiments of the invention, the explanation is illustrative and the invention is limited only by the appended claims.

What is claimed is:

1. An image reading apparatus comprising:

an original tray for placing an original;

a transport path for guiding the original from the original tray to a reading position;

transport means for transporting the original at the reading position toward a downstream side of the reading position in a forward direction, or toward in upstream side of the reading position in a reverse direction;

reading means for reading the original at the reading position;

determination means electrically connected to the reading means for determining whether the original read by the reading means has a black and white image or color image; and a retreat path disposed at the upstream side of the reading position for retreating at least a part of the original from the transport path so that the original read by the reading means and determined by the determination means is transported in the reverse direction relative to the reading position, and the reading means reads the original for a second time in a reading mode according to a result of the determination means after the at least part of the original retreats to the retreat path.

2. An original reading apparatus according to claim 1, wherein said transport means has a first transport speed for determining the original by the determination means, a second speed for transporting the original determined by the determination means in the reverse direction at the reading position, and a third speed for reading the original determined by the determination means for the second time.

3. An image reading apparatus according to claim 2, wherein said first transport speed is set to be greater than the third transport speed, and less than the second transport speed.

4. An image reading apparatus according to claim 1, wherein said reading means stops reading the original and said transport means transports the original in the reverse direction when the determining means determines that the original has the color image.

5. An image reading apparatus according to claim 1, further comprising detection means for detecting whether the original has a length long enough to retreat to the retreat path, said transport means switching a direction that the original is transported at a timing according to a position of a trailing edge of the original when the determining means determines that the original has the color image.

6. An image reading method comprising the steps of:

feeding an original on an original tray and transporting the original to a reading position;

reading the original at the reading position;

determining whether the read original has a black and white image or color image;

transporting the determined original in a reverse direction toward an upstream side relative to the reading position;

transporting the original again toward the reading position; and reading the original supplied again to the reading position in a reading mode according to a result of the determination.

7. An image reading method according to claim 6, further comprising the step of checking whether a trailing edge of the original is located at a position to be transported in the reverse direction before the step of transporting the original in the reverse direction.

8. An image reading apparatus comprising:

a transport path disposed between an original tray and a reading position;

transport means for transporting an original at the reading position toward a downstream side of the reading position in a forward direction or toward an upstream side of the reading position in a reverse direction;

reading means for reading the original at the reading position;

determination means electrically connected to the reading means for determining whether the original has a black and white image or color image;

detection means for detecting whether a trailing edge of the original passes through the reading position; and transport switching means for switching the transport means to move the original from the forward direction to the reverse direction to return the original toward the original tray when the detection means detects that the trailing edge of the original passes through the reading position, and again to move the original to the forward direction so that the reading means reads the original for a second time in a reading mode according to a result of the determining means.

9. An image reading apparatus according to claim 8, further comprising a retreat path extending from the transport path for retreating the original when the original is transported in the reverse direction.

10. An image reading apparatus according to claim 8, wherein in moving the original in the reverse direction, said transport means transports the original until a leading edge of the original passes through the reading position.

11. An image reading method comprising the steps of:

transporting an original on an original tray to a reading position;

reading an image on the original passing through the reading position;

determining whether the original has a black and white image or color image;

transporting the original toward the original tray in a reverse direction after a trailing edge thereof passes through the reading position;

transporting the original toward a downstream side of the reading position after a leading edge of the original passes the reading position so that the original passes through the reading position again; and reading the original for a second time in a reading mode according a result of the determination means while the original passes through the reading position.

12. An image reading apparatus comprising:

a transport path disposed between an original tray and a reading position;

transport means for transporting an original at the reading position toward a downstream side of the reading position in a forward direction, or toward an upstream side of the reading position in a reverse direction;

reading means for reading the original at the reading position;

determination means electrically connected to the reading means for determining whether the original has a black and white image or color image;

circulating path disposed at a downstream side of the reading position for returning the original again to the reading position after the original passes through the reading position;

detection means for detecting a trailing edge of the original; and judging means electrically connected to the detection means for judging a transfer direction of the original based on a position of the trailing edge of the original when the determining means determines that the original has the color image, said judging means transporting the original by the transport means to the reading position in the forward direction after transporting the original in the reverse direction, or by returning the original again to the reading position through the circulating path after the original passes through the reading position, said reading means reading the original for a second time in a reading mode according to a result of the determination means.

13. An image reading apparatus according to claim 12, wherein said circulating path is a switchback path for turning over the original from a front to a back and switching a leading edge and the trailing edge of the original.

14. An image reading apparatus according to claim 13, wherein said reading means reads the original transported via the circulating path after the original is circulated twice through the circulating path.

15. An image reading apparatus according to claim 12, further comprising a retreating path extending from the transport path so that when the transport means transports the original in the reverse direction, at least a part of the original retreats into the retreating path.

16. An image reading method comprising the steps of:

transporting an original on an original tray to a reading position;

reading an image on the original passing through the reading position;

determining whether the original has a black and white image or color image;

detecting a trailing edge of the original;

judging a transport direction of the original according to a position of the trailing edge of the original when the determining means determines that the original has the color image, said judging means judging to transport the original again to the reading position in a forward direction after transporting the original in a reverse direction, or to transport the original again to the reading position through a circulating path after the original passes through the reading position;

supplying the original to the reading position again according to the judgment of the transport direction; and reading the original for a second time in a reading mode according to a result of the determination.

* * * * *